US007607929B1

(12) United States Patent
Nguyen et al.

(10) Patent No.: US 7,607,929 B1
(45) Date of Patent: Oct. 27, 2009

(54) ELECTRICAL CONNECTOR ASSEMBLY HAVING SPRING LOADED ELECTRICAL CONNECTOR

(75) Inventors: Hung Thai Nguyen, Harrisburg, PA (US); Brent D. Yohn, Newport, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/164,777

(22) Filed: Jun. 30, 2008

(51) Int. Cl.
*H01R 13/629* (2006.01)

(52) U.S. Cl. ..... 439/246; 439/700

(58) Field of Classification Search ..... 439/246, 439/700, 247, 248, 824
See application file for complete search history.

(56) References Cited

U.S. PATENT DOCUMENTS 5,516,303 A * 5/1996 Yohn et al. ..... 439/248
5,769,652 A * 6/1998 Wider ..... 439/248
6,699,054 B1 * 3/2004 Critelli ..... 439/248
6,981,889 B1 * 1/2006 Grothen et al. ..... 439/374

* cited by examiner

*Primary Examiner*—Gary F. Paumen

(57) ABSTRACT

An electrical connector assembly includes a housing having a mating end and a connector cavity extending from the mating end along a cavity axis. The housing has a panel wall including first and second sides with an opening extending therebetween and open to the connector cavity. An electrical connector is received in the connector cavity and includes a shell extending along a longitudinal axis. The shell has a flange extending radially outward therefrom that engages the first side of the panel wall. The shell has a groove extending at least partially circumferentially around the shell. A washer is held within the groove of the shell and has a washer engagement surface. A spring concentrically surrounds a portion of the shell. The spring has a front end and a rear end with the front end engaging the washer engagement surface. The rear end faces the flange engagement surface and engages the second side of the panel wall such that the panel wall is captured between the flange and the spring.

21 Claims, 7 Drawing Sheets

ELECTRICAL CONNECTOR ASSEMBLY HAVING SPRING LOADED ELECTRICAL CONNECTOR

BACKGROUND OF THE INVENTION

The subject matter herein relates generally to electrical connector assemblies, and more particularly to spring mounted electrical connectors.

Due to their favorable electrical characteristics, coaxial cables and connectors have grown in popularity for interconnecting electronic devices and peripheral systems. Typically, one connector is mounted to a circuit board of an electronic device at an input/output port of the device and extends through an exterior housing of the device for connection with a coaxial cable connector. The connectors include an inner conductor coaxially disposed within an outer conductor, with a dielectric material separating the inner and outer conductors.

A typical application utilizing coaxial cable connectors is a radio-frequency (RF) application having RF connectors designed to work at radio frequencies in the UHF and/or VHF range. RF connectors are typically used with coaxial cables and are designed to maintain the shielding that the coaxial design offers. RF connectors are typically designed to minimize the change in transmission line impedance at the connection by utilizing contacts that have a short contact length. The connectors have a short mating distance and, particularly when using multiple connectors in a single insert, typically include a pre-compressed spring to ensure the connectors are pushed forward and the contacts are engaged.

Known RF connectors having springs are not without disadvantages. For instance, known connectors allow compression along the axial direction of the connector, thus forcing the contact toward the mating contact. However, during mating, the contact axes of the connectors may not be properly aligned with one another. The spring thus forces the contact in an undesired direction and may cause damage to the contacts. Additionally, when an array of the connectors are simultaneously mated, there is a greater chance that at least some of the connectors are not properly aligned with the mating connectors. Furthermore, known connectors may be difficult and/or costly to assemble. For example, positioning of the spring around the connector may be difficult.

A need remains for a connector assembly that may be manufactured in a cost effective and reliable manner. A need remains for a connector assembly that may be mated in a safe and reliable manner.

BRIEF DESCRIPTION OF THE INVENTION

In one embodiment, an electrical connector assembly is provided that includes a housing having a mating end and a connector cavity extending from the mating end along a cavity axis. The housing has a panel wall including first and second sides with an opening extending therebetween and open to the connector cavity. An electrical connector is received in the connector cavity and includes a shell extending along a longitudinal axis. The shell has a flange extending radially outward therefrom that engages the first side of the panel wall. The shell has a groove extending at least partially circumferentially around the shell. A washer is held within the groove of the shell and has a washer engagement surface. A spring concentrically surrounds a portion of the shell. The spring has a front end and a rear end with the front end engaging the washer engagement surface. The rear end faces the flange engagement surface and engages the second side of the panel wall such that the panel wall is captured between the flange and the spring.

Optionally, the electrical connector may extend through the opening in the panel wall such that a portion of the electrical connector is within the connector cavity and a portion of the electrical connector is outside the connector cavity. The spring may be at least partially compressed between the washer and the panel wall. The spring may be compressed during mating of the electrical connector with the mating connector such that the relative position of the mating end with respect to the panel wall changes as the electrical connector is mated with the mating connector.

In another embodiment, an electrical connector assembly is provided that includes a housing having a mating end and a connector cavity extending from the mating end along a cavity axis where the housing has a panel wall including first and second sides with an opening extending therebetween and open to the connector cavity. The opening having an opening diameter. The electrical connector assembly also includes an electrical connector having a shell extending along a longitudinal axis with the shell being cylindrical and having a shell diameter that is less than the opening diameter. The electrical connector has a flange extending radially outward therefrom with the flange being configured to engage the first side of the panel wall. The electrical connector is coupled to the housing such that a portion of the shell is received within the connector cavity and a portion of the shell extends through the opening. A spring concentrically surrounds a portion of the shell and has a front end and a rear end. The front end is held by the electrical connector and the rear end engages the second side of the panel wall such that the panel wall is captured between the flange and the spring. The electrical connector is configured to float within the connector cavity in at least two non-parallel directions.

Optionally, the electrical connector may be movable in a first direction along the longitudinal direction and in a second direction transverse to the longitudinal axis. The electrical connector may be movable in a lateral direction that is perpendicular to the longitudinal axis and in a pitch direction that is non-orthogonal with respect to the longitudinal axis. The opening diameter may be greater than the shell diameter such that the shell is movable within the opening in a non-axial direction.

In a further embodiment, an electrical connector is provided that is configured to be mounted to a panel wall. The electrical connector includes a shell having a cable end and a mating end and extends along a longitudinal axis. The shell has a flange extending radially outward therefrom that has a flange engagement surface configured to engage a first side of the panel wall. The shell has a groove extending at least partially circumferentially around the shell. A contact is received within the shell and is arranged along the longitudinal axis proximate the mating end. The contact is configured to be electrically coupled to a center conductor of a coaxial cable. A washer is received within the groove of the shell and has a washer engagement surface. A spring concentrically surrounding a portion of the shell and has a front end and a rear end. The front end engages the washer engagement surface. The rear end faces the flange engagement surface and is configured to engage a second side of the panel wall opposite to the first side such that the panel wall is captured between the flange and the spring.

DETAILED DESCRIPTION OF THE INVENTION

Figure 1:
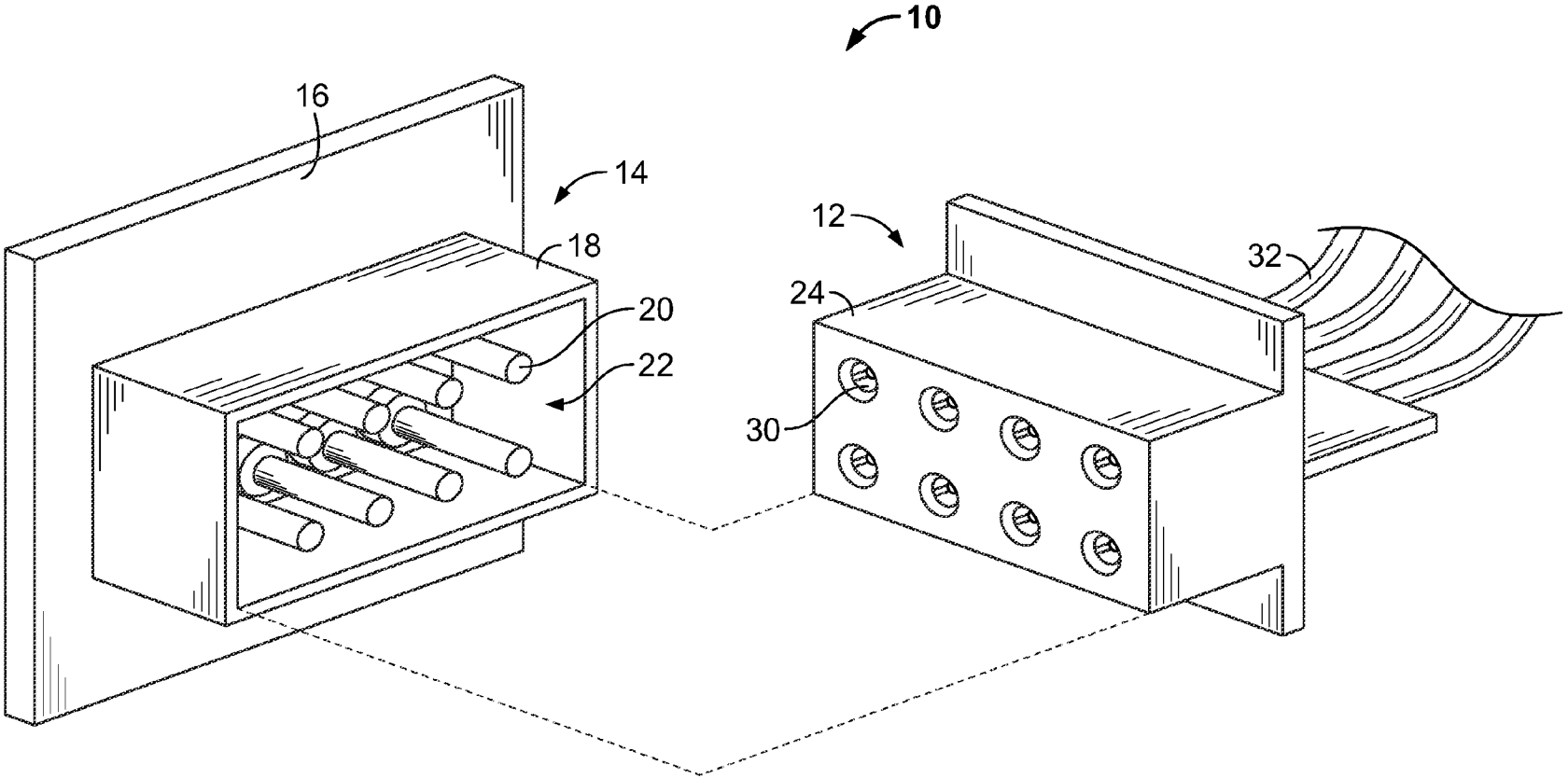
FIG. 1 illustrates an electrical connector system including first and second connector assemblies.

FIG. 1 illustrates an electrical connector system 10 including an electrical connector assembly 12 and a mating connector assembly 14 formed in accordance with an exemplary embodiment. In an exemplary embodiment, the mating connector assembly 14 defines a header assembly and is board mounted to a circuit board 16. The mating connector assembly 14 includes a housing 18 and a plurality of mating connectors 20 held within the housing 18. The housing 18 includes a mating cavity 22 that defines a receptacle for receiving the electrical connector assembly 14. Any number of mating connectors 20 may be utilized depending on the particular application. In the illustrated embodiment, eight mating connectors 20 are provided in two rows.

In an exemplary embodiment, the electrical connector assembly 12 defines a plug that may be received within the mating cavity 22. The electrical connector assembly 12 includes a housing 24 and a plurality of electrical connectors 30 held within the housing 24. The electrical connectors 30 are cable mounted to respective coaxial cables 32. The electrical connector assembly 12 and mating connector assembly 14 are mated with one another such that the mating connectors 20 mate with the electrical connectors 30. In alternative embodiments, the electrical connector assembly 12 and mating connector assembly 14 are both board mounted, or alternatively, the electrical connector assembly 12 and mating connector assembly 14 are both cable mounted.

Figure 2:
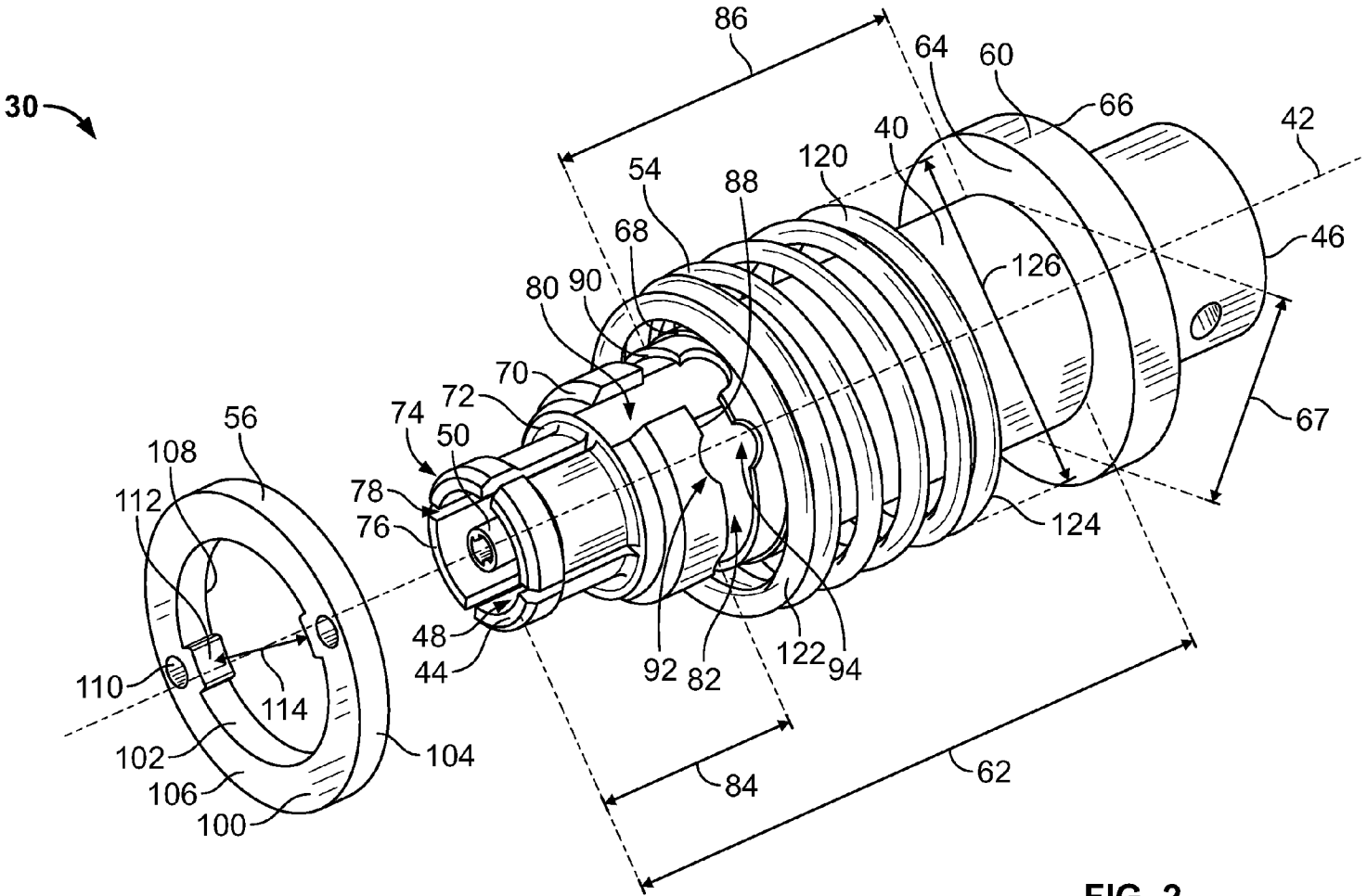
FIG. 2 is an exploded perspective view of an electrical connector for use with the system shown in FIG. 1.

FIG. 2 is an exploded perspective view of one of the electrical connectors 30. The electrical connector 30 includes a shell 40 extending along a central longitudinal axis 42 between a mating end 44 and a cable end 46. The shell 40 defines a shell cavity 48. The electrical connector 30 includes a contact 50 held within the shell cavity 48. In an exemplary embodiment, a dielectric body 52 (shown in FIG. 4) is positioned between the shell 40 and the contact 50. In an exemplary embodiment, the shell 40 is formed from a conductive material, such as a metal material, and the body 52 electrically separates the contact 50 and the shell 40. The electrical connector 30 includes a spring 54 concentrically surrounding a portion of the shell 40. The electrical connector 30 includes a retaining washer 56 used to retain the spring 54 in position with respect to the shell 40.

The shell 40 is cylindrical in shape. A flange 60 extends radially outward from the shell 40. The flange 60 is positioned proximate the cable end 46. In the illustrated embodiment, the flange 60 is positioned a distance 62 from the mating end 44. The flange 60 includes a forward facing surface 64 and a rear facing surface 66. The surfaces 64, 66 are generally perpendicular with respect to the longitudinal axis 42.

The shell 40 is tapered or stepped at the mating end 44 such that a shell diameter 67 at the mating end 44 is smaller than along other portions of the shell 40. For example, the shell 40 includes a first shoulder 68, a second shoulder 70 forward of the first shoulder 68, and a third shoulder 72 forward of the second shoulder 70. The shell diameter 67 is smaller forward of each shoulder 68, 70, 72. Any number of shoulders may be provided in alternative embodiments. The shell 40 includes a tip portion 74 forward of the third shoulder 72. When the electrical connector 30 is mated with the mating connector 20 (shown in FIG. 1), the tip portion 74 is received within the mating connector 20. In an exemplary embodiment, the tip portion 74 includes a plurality of segments 76 that are separated by gaps 78. The segments 76 are movable with respect to one another such that the segments may be deflected toward one another to reduce the diameter of the tip portion 74 for mating with the mating connector 20. Deflection of the segments 76 may cause a friction fit with the mating connector 20 when mated.

In an exemplary embodiment, a slot 80 is formed in the shell 40 at the mating end 44. Optionally, multiple slots 80 may be provided. For example, two slots 80 may be provided and arranged on diametrically opposite sides of the shell 40 from one another. Any number of slots 80 may be provided in alternative embodiments. In the illustrated embodiment, the slots 80 extend from the third shoulder 72 to the first shoulder 68, however the slots 80 may extend further than, or less than, the first shoulder 68 in alternative embodiments.

In an exemplary embodiment, a groove 82 is formed in the shell 40 at the mating end 44. The groove 82 extends at least partially circumferentially around the shell 40 at a depth 84 from the mating end 44. The groove 82 is positioned an axial distance 86 from the flange 60. The groove 82 has a smaller diameter than the shell diameter 67 along the portion of the shell 40 having the groove 82, such that the groove 82 includes a front wall 88 and a rear wall 90. In the illustrated embodiment, the groove 82 extends entirely circumferentially around the shell 40. The groove 82 is positioned between the first and second shoulders 68, 72. Optionally, the groove 82 may be positioned at one of, or both of, the first or second shoulders 68, 72. In an exemplary embodiment, the slots 80 intersect the groove 82. The slots 80 open to the groove 82. In an exemplary embodiment, the groove 82 includes at least one detention feature 92 formed in the front wall 88 and at least one detention feature 94 formed in the rear wall 90. The detention features 92, 94 are aligned with one another an arc length 96 from the slot 80. The detention features 92, 94 may be radiused or curved, or alternatively, may be rectangular in shape.

The washer 56 includes a ring-shaped body 100 having a radially inner surface 102 and a radially outer surface 104. The washer 56 includes a forward facing surface 106 and a rear engagement surface 108. In an exemplary embodiment, the washer 56 includes at least one opening 110 in the forward facing surface 106. Optionally, the openings 110 may extend entirely through the washer 56. The washer 56 includes at least one rib 112 extending radially inward from the inner surface 102. In the illustrated embodiment, two ribs 112 are provided and arranged diametrically opposed to one another. The ends of the ribs 112 are separated from one another by a distance 114 generally less than an inner diameter of the washer 56. As will be described in further detail below, the ribs 112 are sized and shaped to fit within the slots 80 and the groove 82 of the shell 40.

The spring 54 has a helically wound body 120 extending between a front end 122 and a rear end 124. The rear end 124 faces the forward facing surface 64 of the flange 60. The spring 54 is loaded over the mating end 44 and concentrically surrounds a portion of the shell 40. The spring 54 has a spring diameter 126 that is greater than the shell diameter 67. The spring 54 is compressible axially.

Figure 3:
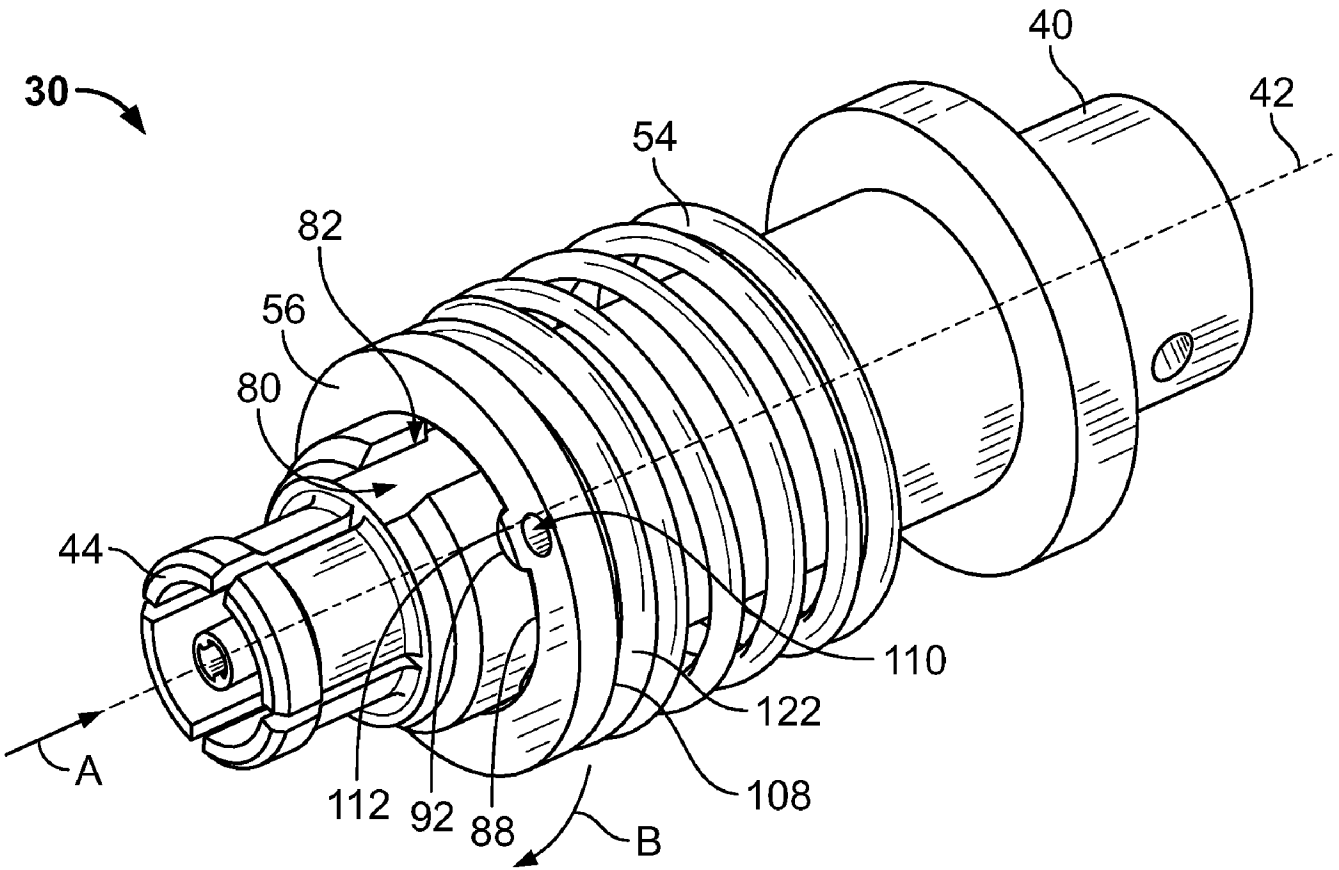
FIG. 3 is an assembled perspective view of the electrical connector shown in FIG. 2.

FIG. 3 is an assembled perspective view of the electrical connector 30. During assembly, the retaining washer 56 is loaded onto the mating end 44 of the shell 30 and holds the spring 54 in position relative to the shell 40. During assembly, the washer 56 is aligned with the mating end 44 such that the ribs 112 are aligned with the slots 80 in the shell 40. The washer 56 is loaded over the mating end 44 in a loading direction, shown by an arrow A, which is generally along the longitudinal axis 42. The mating end 44 passes through the central bore of the washer 56. The ribs 112 fit within the slots 80. The washer 56 is loaded onto the shell 40 in the loading direction to a loaded position, in which the washer 56 is aligned with the groove 82. In the loaded position, the rear engagement surface 108 of the washer 56 may engage the front end 122 of the spring 54. Optionally, in the loaded position, the washer 56 may at least partially compress the spring 54 such that the spring is biased against the washer 56.

During assembly, when the ribs 112 are aligned with the groove 82, the washer 56 is rotated in a locking direction, shown in FIG. 3 by an arrow B, that is transverse to the loading direction. The ribs 112 pass through the groove 82 to a locked position. For example, the washer 56 is rotated until the ribs 112 are aligned with the detention features 92, 94. In the locked position, the ribs 112 are captured by at least one of the detention features, such as the front detention feature 92. Optionally, the spring 54 is biased against the washer 56 such that the washer 56 is forced against the front wall 88 of the groove 80 as the washer 56 is rotated to the locked position. The spring 54 forces the ribs 112 of the washer 56 into the detention feature 92 when the ribs 112 are aligned with the detention feature 92. The walls of the detention feature 92 generally resist rotational movement of the washer 56 when the washer 56 is in the locked position.

In an exemplary embodiment, a tool is used to load the washer 56 onto the shell 40 and rotate the washer 56 to the locked position. For example, a tool having at least one pin is used, where the pin is fit into the openings 110 in the washer 56. The tool loads the washer 56 onto the mating end 44 to the loaded position, and then rotation of the tool causes the washer 56 to rotate to the locked position. A similar operation may be used to unlock and/or unload the washer 56 from the shell 40. For example, during unlocking, the tool may be used to disengage the ribs 112 from the detention feature, such as by pushing the washer 56 in the direction of arrow A until the ribs 112 are aligned with the groove 82. The tool may be used to rotate the washer 56 in a direction opposite to the arrow B until the ribs 112 of the washer 56 are aligned with the slots 80. The spring 54 and/or the tool may then be used to unload the washer 56 from the mating end 44 in a direction opposite to the arrow A.

Figure 4:
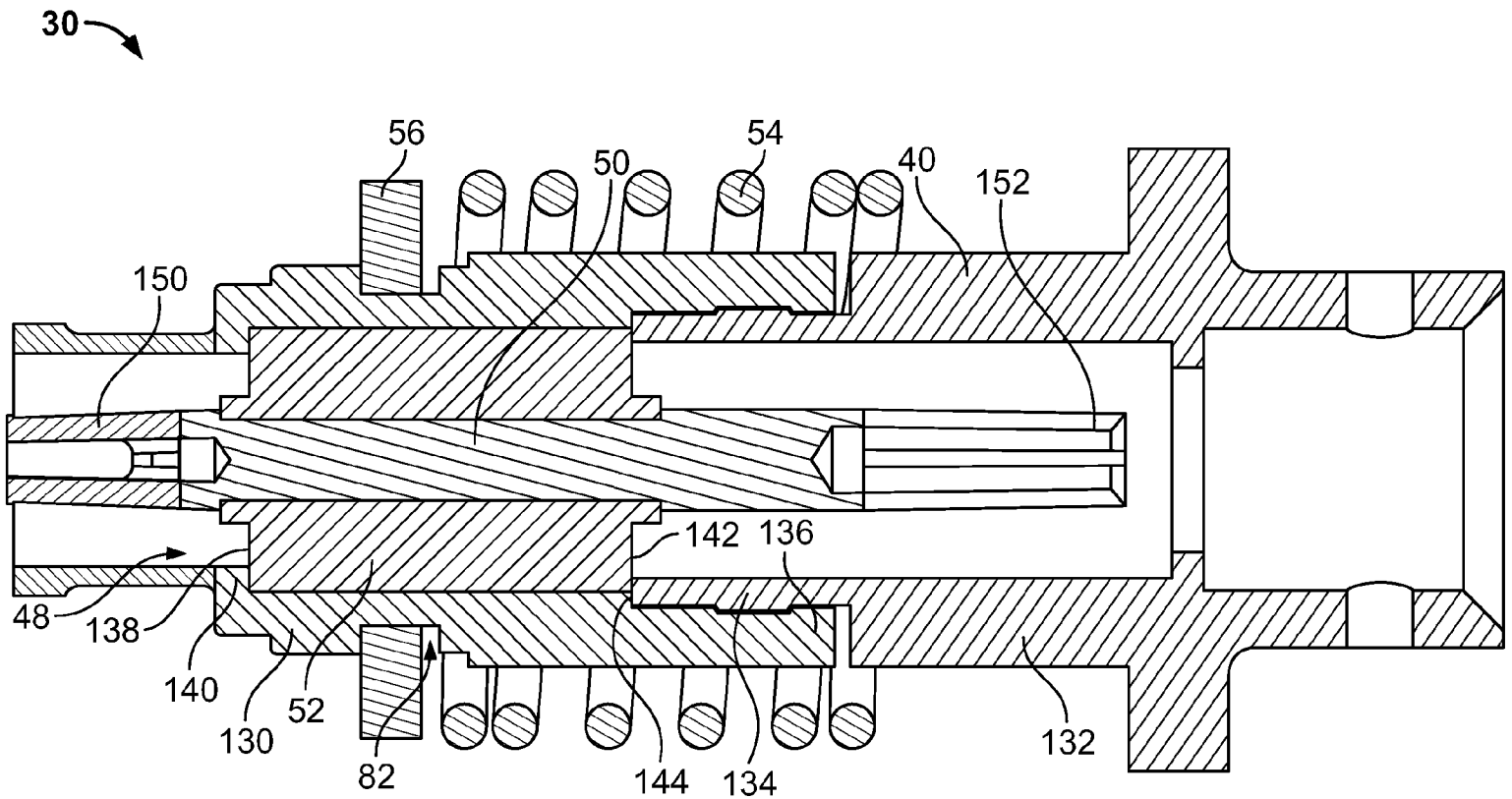
FIG. 4 is a cross-sectional view of the electrical connector shown in FIG. 3.

FIG. 4 is a cross-sectional view of the electrical connector 30. FIG. 4 illustrates the spring 54 loaded onto the shell 40, and the washer 56 in the locked position within the groove 82. In the illustrated embodiment, the shell 40 includes a front shell 130 and a rear shell 132. A nose 134 of the rear shell 132 is received in a hood 136 of the front shell 130. The dielectric body 52 is held within the shell cavity 48. For example, a front end 138 of the body 52 engages a lip 140 of the front shell 130 proximate to the mating end 44. A rear end 142 of the body 52 engages a front surface 144 of the rear shell 132. The body 52 is captured in the front shell 130 by the rear shell 132.

The contact 50 is held within the shell cavity 48 by the dielectric body 52. The contact 50 includes a mating end 150 and a terminating end 152. The mating end 150 is configured to mate with a mating contact 154 (shown in FIG. 5) of the mating connector 20. The mating end 150 is positioned proximate to the mating end 44 of the shell 40. The terminating end 152 is configured to be terminated to a cable, such as, to a center conductor (not shown) of a coaxial cable. The rear shell 132 is configured to mechanically and/or electrically connected to the cable, such as, to the cable braid, the cable insulator and/or the cable jacket.

Figure 5:
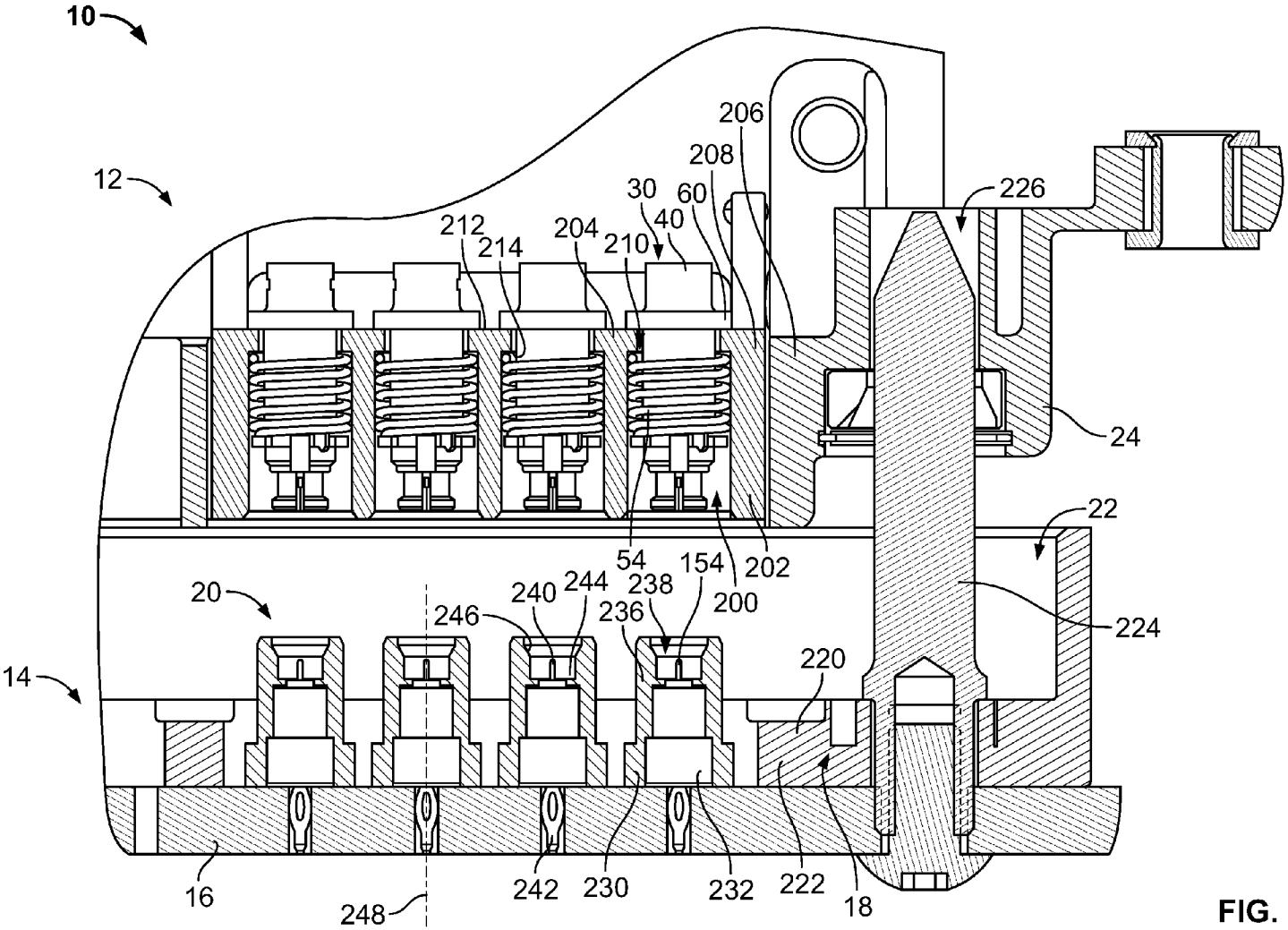
FIG. 5 is a partial cross sectional view of the system shown in FIG. 1 illustrating the first and second connector assemblies in an unmated position.

FIG. 5 is a partial cross sectional view of the connector system 10 illustrating the electrical connector assembly 12 and mating connector assembly 14 in an unmated position. The electrical connector assembly 12 includes the housing 24 and a plurality of the electrical connectors 30 (not shown in cross-section in FIG. 5). The housing 24 includes a plurality of connector cavities 200 extending between a mating end 202 and a panel wall 204 on a back side of the housing 24. In the illustrated embodiment, separate pieces are coupled together to form the housing 24. For example, the housing 24 may be defined by a main housing 206 and a module housing 208 that is part of a module coupled within the main housing 206. Optionally, a plurality of modules may be coupled within the main housing 206. The modules may be identical or may be formed differently and/or hold different types of connectors. In some embodiments, the housing 24 may be a single piece defining the connector cavities 200 and panel wall 204.

The panel wall 204 includes a plurality of openings 210 therethrough that provide access to the connector cavities 200. The electrical connectors 30 extend through the openings 210 into the connector cavities 200. In an exemplary embodiment, a portion of the shell 40 is positioned outside of the housing 24 (e.g. rearward or behind the panel wall 204), and a portion of the shell 40 is positioned inside the connector cavity 200. The panel wall 204 includes first and second sides 212, 214, with the first side 212 facing outside of the housing 24 and the second side 214 facing the connector cavity 200. In an exemplary embodiment, the electrical connector 30 is received in the connector cavity 200 such that the forward facing surface 64 of the flange 60 faces and/or engages the first side 212 of the panel wall 204. The flange 60 defines a stop against the panel wall 204 that limits forward movement of the electrical connector 30 relative to the housing 24. The spring 54 engages the second side 214 of the panel wall 204. In an exemplary embodiment, the spring 54 is biased against the panel wall 204 to position the electrical connector 30 relative to the panel wall 204. As such, the panel wall 204 is positioned between the spring 54 and the flange 60.

The mating connector assembly 14 includes the housing 18 and a plurality of the mating connectors 20. The housing 18 and mating connectors 20 are mounted to the circuit board 16. The housing 18 includes the mating cavity 22 and the mating connectors 20 extend at least partially into the mating cavity 22. The housing 18 includes base walls 220 at a board mounting end 222 of the housing 18. Optionally, an alignment post 224 is coupled to the housing 18 and is received in an alignment opening 226 in the housing 24 of the electrical connector assembly 12. The alignment post 224 aligns the connector assemblies 12, 14 during mating.

Each mating connector 20 include a shell 230, a dielectric body 232 received in the shell 230 and a mating contact 154 held by the body 232. The body 232 electrically isolates the mating contact 154 from the shell 230. The shell 230 includes a mating end 236 having an opening 238 that receives the electrical connector 30 during mating. The contact 154 includes a mating end 240 and a mounting end 242 that is mounted to the circuit board 16. In en exemplary embodiment, the contact 154 is through-hole mounted to the circuit board 16 using an eye-of-the-needle pin. The opening 238 includes a bottom 244 and is defined by a stepped wall 246. The mating connector 20 extends along a longitudinal axis 248. During mating, the longitudinal axis 42 of each electrical connector 30 is generally aligned with the longitudinal axis 248 of the corresponding mating connector 20.

Figure 6:
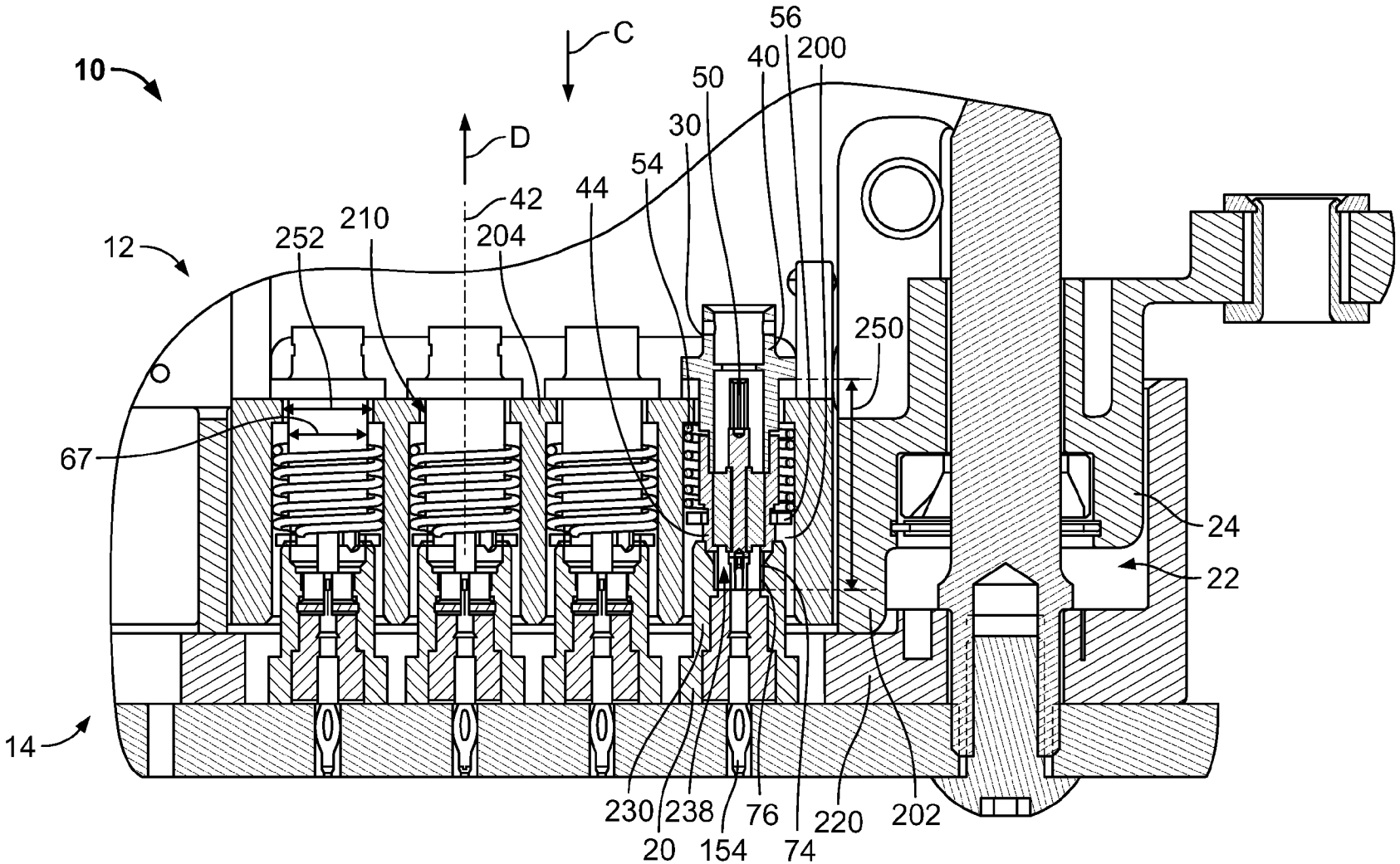
FIG. 6 is a partial cross sectional view of the system shown in FIG. 1 illustrating the first and second connector assemblies in a mated position.

FIG. 6 is a partial cross sectional view of the connector system 10 illustrating the electrical connector assembly 12 and mating connector assembly 14 in a mated position. During mating, the electrical connector assembly 12 is loaded into the mating cavity 22 in a loading direction, shown in FIG. 6 by an arrow C. Optionally, the electrical connector assembly 12 is loaded into the mating cavity 22 until the mating end 202 of the housing 24 engages the base wall 220.

As the electrical connector assembly 12 is mated with the mating connector assembly 14, the electrical connector 30 mates with the mating connector 20. In the mated position, the tip portion 74 of the electrical connector 30 is received in the opening 238 of the mating connector 20. Optionally, the segments 76 of the tip portion 74 may be flexed inward to fit within the opening 238. The tip portion 74 may be resiliently held within the opening 238. In the mated position, the contact 50 engages, and electrically connects to, the mating contact 154. In an exemplary embodiment, the shell 40 engages, and electrically connects to, the shell 230.

During mating, the spring 54 allows the electrical connector 30 to float within the connector cavity 200 where the electrical connector 30 is repositioned with respect to the housing 24. Such floating or repositioning allows for proper mating of the electrical connector 30 with the mating connector 20. For example, the spring 54 may be compressed such that the relative position of the mating end 44 with respect to the panel wall 204 changes as the electrical connector 30 is mated with the mating connector 20.

In an exemplary embodiment, the spring 54 may compress or flex to allow the electrical connector 30 to reposition axially along the longitudinal axis 42 in a longitudinal direction, shown in FIG. 6 by the arrow D. A distance 250 between the mating end 44 and the panel wall 204 may be shortened when the electrical connector 30 is mated with the mating connector 20. For example, when the tip portion 74 engages the mating connector 20, the spring 54 may be compressed and the electrical connector 30 may be recessed within the connector cavity 200. When the electrical connector 30 is recessed within the connector cavity 200, the flange 60 is moved away from the panel wall 204. When the spring 54 is compressed, the spring 54 exerts a relatively higher biasing force against the washer 56 than when the spring 54 is not compressed, or when the spring 54 is less compressed. The biasing force is applied in a biasing direction, which may be generally along the longitudinal axis 42 toward the mating connector 20. The spring 54 may maintain a reliable connection between the contact 50 and the mating contact 154 by forcing the electrical connector 30 generally toward the mating connector 20.

In addition to, or alternatively to, the axial repositioning of the electrical connector 30, the electrical connector 30 may be repositioned in a direction transverse to the longitudinal axis 42. For example, the electrical connector 30 may be moved in a radial direction generally perpendicular with respect to the longitudinal axis 42. Optionally, the opening 210 in the panel wall 204 may have a larger diameter 252 than the shell diameter 67 such that the shell 40 is movable within the opening in a non-axial direction (e.g. such as in a direction generally toward a portion of the opening 210). In an exemplary embodiment, in addition to, or alternatively to, the radial repositioning of the electrical connector 30, the electrical connector 30 may be repositioned by pivoting the electrical connector 30 such that the longitudinal axis 42 is non-parallel to the central axis of the connector cavity 200. Such radial repositioning and/or pivoting may allow the electrical connector 30 to align with the mating connector 20 during mating.

Figure 7:
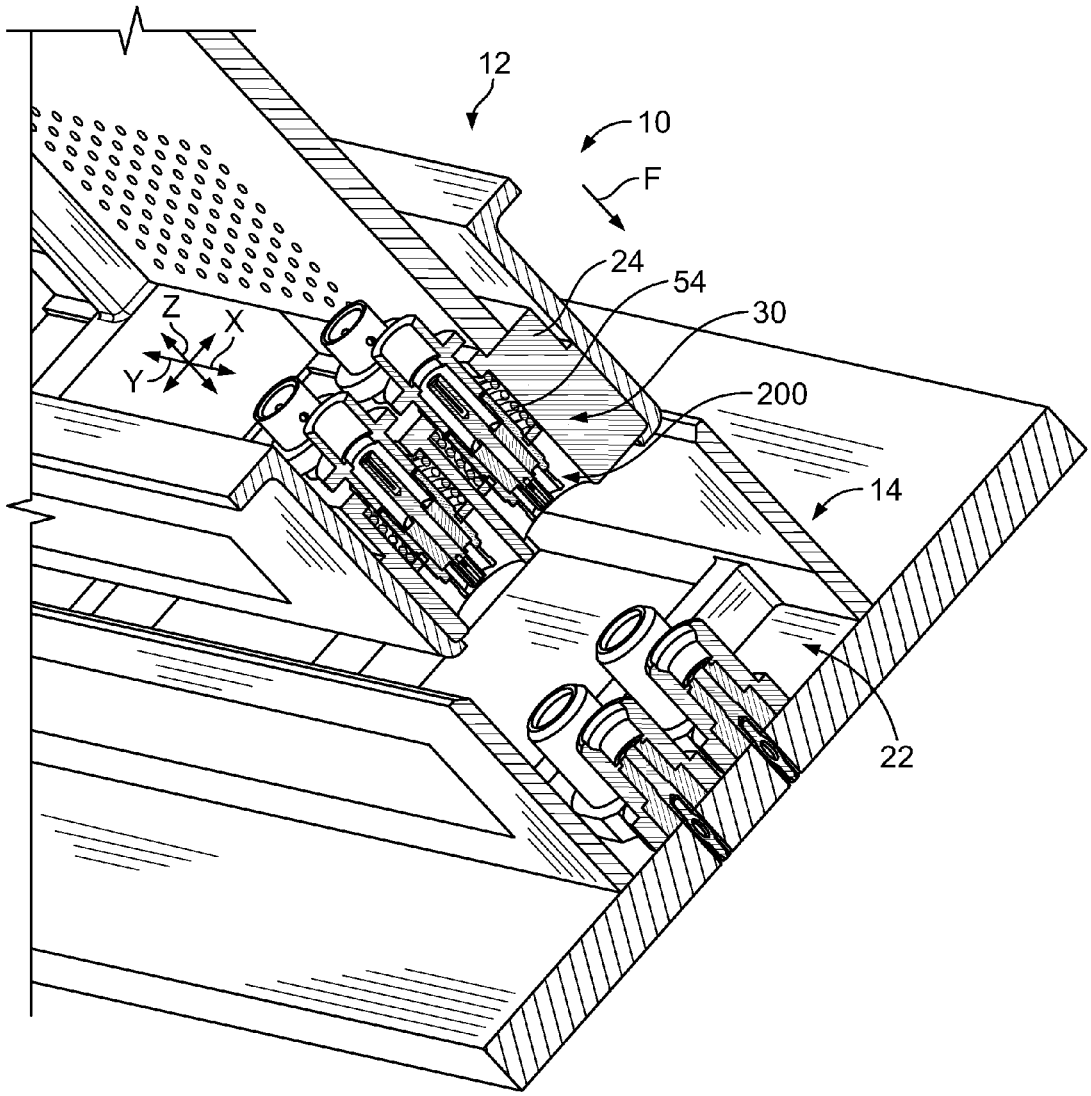
FIG. 7 is a partial cross sectional view of the system shown in FIG. 1 illustrating the first and second connector assemblies during mating.

FIG. 7 is a partial cross sectional view of the connector system 10 illustrating the electrical connector assembly 12 and mating connector assembly 14 during mating. During mating, the electrical connector assembly 12 is loaded into the mating cavity 22 in a loading direction, shown in FIG. 7 by an arrow F. During mating, the spring 54 allows the electrical connector 30 to float within the connector cavity 200 where the electrical connector 30 is repositioned with respect to the housing 24. Such floating or repositioning allows for proper mating of the electrical connector 30 with the mating connector 20.

In an exemplary embodiment, the electrical connector 30 may float within the connector cavity 200 in at least two non-parallel directions. For example, the electrical connector 30 may float in an axial direction, shown in FIG. 7 by the arrow Z. The electrical connector 30 may float in a first lateral direction and/or a second lateral direction, such as in the directions shown by arrows X and/or Y. The electrical connector 30 may float in any combination of the directions shown by the arrows X-Y-Z. The electrical connector 30 may be pivoted, such that the mating end 44 is shifted in at least one of the lateral directions X and/or Y. The floating of the electrical connector 30 may properly align the electrical connector 30 with respect to the mating connector 20. Optionally, the floating may be caused by engagement of the electrical connector 30 with the mating connector 20 during mating.

An exemplary embodiment of an electrical connector assembly 12 is thus provided that may be manufactured in a cost effective and reliable manner. The electrical connector assembly 12 may be mated with the mating connector assembly 14 in a reliable manner. The electrical connector 30 is movably received within the connector cavity 200 to properly mate with the mating connector 20. In an exemplary embodiment, the electrical connector 30 includes a spring 54 that allows the electrical connector 30 to float within the connector cavity 200 in a plurality of directions or along a range of different movements. Assembly of the electrical connector 30 is simplified by providing the spring 54 on the outside of the electrical connector 30 and using the washer 56 to hold the spring 56 against the panel wall 204. The washer 56 includes ribs 112 that are loaded into slots 80 and the groove 80 to hold the washer 56 in position with respect to the shell 40.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. An electrical connector assembly comprising:

a housing having a mating end and a connector cavity extending from the mating end along a cavity axis, the housing having a panel wall including first and second sides with an opening extending therebetween and open to the connector cavity; and an electrical connector received in the connector cavity, the electrical connector comprising a shell extending along a longitudinal axis, the shell having a flange extending radially outward therefrom, the flange engaging the first side of the panel wall, the shell having a groove extending at least partially circumferentially around the shell, the electrical connector comprising a washer held within the groove of the shell, the washer having a washer engagement surface, and the electrical connector comprising a spring concentrically surrounding a portion of the shell, the spring having a front end and a rear end, the front end facing the washer engagement surface, the rear end facing the flange engagement surface and engaging the second side of the panel wall such that the panel wall is captured between the flange and the spring.

2. The electrical connector assembly of claim 1, wherein the electrical connector extends through the opening in the panel wall such that a portion of the electrical connector is within the connector cavity and a portion of the electrical connector is outside the connector cavity.

3. The electrical connector assembly of claim 1, wherein the front end of the spring engages the washer engagement surface and the rear end of the spring engages the second side of the panel wall, the spring being at least partially compressed between the washer and the panel wall.

4. The electrical connector assembly of claim 1, wherein the spring is compressed during mating of the electrical connector with the mating connector such that the relative position of a mating end of the shell with respect to the panel wall changes as the electrical connector is mated with the mating connector.

5. The electrical connector assembly of claim 1, wherein the shell includes a mating end spaced from the panel wall by a distance, the spring being compressed during mating of the electrical connector with the mating connector such that the distance is shortened when the electrical connector is mated with the mating connector.

6. The electrical connector assembly of claim 1, wherein the washer includes a rib extending radially inward from a washer body, the rib being held within the groove to maintain an axial position of the washer with respect to the shell.

7. An electrical connector assembly comprising:

a housing having a mating end and a connector cavity extending from the mating end along a cavity axis, the housing having a panel wall including first and second sides with an opening extending therebetween and open to the connector cavity, the opening having an opening diameter;

an electrical connector having a shell extending along a longitudinal axis, the shell being cylindrical and having a shell diameter that is less than the opening diameter, the electrical connector having a flange extending radially outward therefrom, the flange being configured to engage the first side of the panel wall, the electrical connector being coupled to the housing such that a portion of the shell is received within the connector cavity and a portion of the shell extends through the opening; and a spring concentrically surrounding a portion of the shell, the spring having a front end and a rear end, the front end being held by the electrical connector, the rear end engaging the second side of the panel wall such that the panel wall is captured between the flange and the spring, wherein the electrical connector is configured to float within the connector cavity in at least two non-parallel directions.

8. The electrical connector assembly of claim 7, wherein the electrical connector includes a mating end, the mating end being movable within the connector cavity in at least two non-parallel directions.

9. The electrical connector assembly of claim 7, wherein the electrical connector is movable in a first direction along the longitudinal axis and in a second direction transverse to the longitudinal axis.

10. The electrical connector assembly of claim 7, wherein the electrical connector is movable in a lateral direction that is perpendicular to the longitudinal axis and in a pitch direction that is non-orthogonal with respect to the longitudinal axis.

11. The electrical connector assembly of claim 7, wherein the opening diameter is greater than the shell diameter such that the shell is movable within the opening in a non-axial direction.

12. The electrical connector assembly of claim 7, further comprising a washer coupled to the shell, the washer having a washer engagement surface, the spring being captured between the washer engagement surface and the second side of the panel wall.

13. The electrical connector assembly of claim 7, wherein the shell includes a groove extending at least partially circumferentially around the shell, the groove having at least one detention feature, the electrical connector assembly further comprising a washer being held within the groove and at least partially received within the detention feature to maintain a position of the washer with respect to the shell, the spring being held relative to the shell by the washer.

14. An electrical connector configured to be mounted to a panel wall, the electrical connector comprising:

a shell having a cable end and a mating end, the shell extending along a longitudinal axis, the shell having a flange extending radially outward therefrom, the flange having a flange engagement surface configured to engage a first side of the panel wall, the shell having a groove extending at least partially circumferentially around the shell and the shell having a slot extending axially along an outer surface of the shell to the groove;

a contact received within the shell, the contact being arranged along the longitudinal axis proximate the mating end;

a washer received within the groove of the shell, the washer having a washer engagement surface; and a spring concentrically surrounding a portion of the shell, the spring having a front end and a rear end, the front end facing the washer engagement surface, the rear end facing the flange engagement surface and configured to engage a second side of the panel wall opposite to the first side such that the panel wall is captured between the flange and the spring.

15. The electrical connector of claim 14, wherein the groove extends entirely circumferentially around the shell.

16. The electrical connector of claim 14, wherein the groove is positioned an axial distance from the flange.

17. The electrical connector of claim 14, wherein the slot extends from proximate to the mating end of the shell to the groove.

18. The electrical connector of claim 14, wherein the groove is defined by a front wall and a rear wall, the groove includes at least one detention feature formed in at least one of the front wall and the rear wall.

19. The electrical connector of claim 14, wherein the washer includes a ring-shaped body having a radially inner surface and at least one rib extending radially inward from the inner surface.

20. The electrical connector of claim 19, wherein the rib is received in the groove.

21. The electrical connector of claim 19, wherein the shell has an outer surface having an outer diameter, the groove has a groove diameter less than the outer diameter, the inner surface of the washer has an inner diameter substantially equal to the outer diameter, the rib extending from the inner surface and configured to fit within the groove diameter.

* * * * *